US006481132B1

(12) United States Patent
Grate et al.

(10) Patent No.: US 6,481,132 B1
(45) Date of Patent: Nov. 19, 2002

(54) SIGN

(76) Inventors: Anton Grate, 38 Coventry Chase, Joliet, IL (US) 60431; Cheryl Grate, 708 Cambridge La., Shorewood, IL (US) 60435

( * ) Notice: Subject to any disclaimer, the term of this patent is extended or adjusted under 35 U.S.C. 154(b) by 0 days.

(21) Appl. No.: 09/490,104

(22) Filed: Jan. 24, 2000

(51) Int. Cl.[7] ..... G09F 13/04; G09F 7/02
(52) U.S. Cl. ..... 40/575; 40/541; 40/611
(58) Field of Search ..... 40/575, 541, 574, 40/714, 716, 781, 611, 564, 361, 366, 367

(56) References Cited

U.S. PATENT DOCUMENTS

| | | | | | |
|---|---|---|---|---|---|
| 2,766,540 | A | * | 10/1956 | Brown et al. | 40/575 |
| 3,824,726 | A | * | 7/1974 | Schubert | 40/564 |
| 4,070,779 | A | * | 1/1978 | Gilmour | 40/575 |
| 4,187,632 | A | * | 2/1980 | Rydstrom | 40/446 |
| 4,292,752 | A | * | 10/1981 | Clark | 40/576 |
| 4,547,987 | A | * | 10/1985 | Stilling | 40/574 |
| 4,682,430 | A | * | 7/1987 | Ramsay | 40/576 |
| 4,714,984 | A | * | 12/1987 | Spector | 40/575 |
| 4,796,170 | A | * | 1/1989 | Pedersen et al. | 40/564 |
| 4,903,423 | A | * | 2/1990 | Hinca | 40/574 |
| 5,199,202 | A | * | 4/1993 | Musgrave | 40/219 |
| 5,243,777 | A | * | 9/1993 | Dedlow | 40/152.1 |
| 5,457,905 | A | * | 10/1995 | Kaplan | 40/574 |
| 5,555,654 | A | * | 9/1996 | Hermann | 40/714 |
| 5,680,721 | A | * | 10/1997 | Hine, Jr. | 40/611 |
| 5,943,801 | A | * | 8/1999 | Wilkinson | 40/564 |
| 6,035,571 | A | * | 3/2000 | Hsu | 40/781 |

* cited by examiner

*Primary Examiner*—Lynne H. Browne
*Assistant Examiner*—Kenn Thompson
(74) *Attorney, Agent, or Firm*—Robert L. Marsh

(57) ABSTRACT

A sign has an enclosure including a transparent forward panel. Behind the transparent forward panel are upper and lower tracks for receiving a replaceable partially transparent panel having advertising material printed thereon. The enclosure has a removeable panel through which the replaceable panel of advertising material can be inserted or removed from the tracks. In another embodiment, the panel with advertising material is formed as a cartridge having a mounting portion to which a flexible panel of having advertising material thereon can be attached.

6 Claims, 6 Drawing Sheets

SIGN

The present invention relates to signs and, in particular, to an improved directional sign which can be employed for purposes other than directing the traffic flow of customer vehicles.

BACKGROUND OF THE INVENTION

Fast food stores make efficient use of space with the building and parking lot occupying all of the useable land. The signage for a typical national franchise fast food store consists of a large elevated structure displaying the name of the franchise and two or more smaller structures positioned at the access drives for the parking facilities to designate the entrance and the exit.

Such stores benefit from national and local television and newspaper advertisements of specials which are intended to attract customers away from competitors. Local stores, however, often do not have signage facilities for touting the "specials" being offered from the parent franchiser and, therefore, local stores generally promote such specials by hanging sheets of signage along the inside of windows in the store. The use of the store windows as advertising surfaces, however, detracts from the general appearance of the store.

The two smaller directional signs designate the entrance and exit of the parking facilities and are generally positioned along the forward boundary of the property where they are readily visible to passengers in cars on the adjacent roadway. Such directional signs consist of a rectangular shaped enclosure with lighting fixtures therein mounted on a pedestal. The forward surface of the enclosure has signage painted thereon designating the direction in which vehicles are to enter or exit.

Although it is important to designate the entrance and exit of the fast food store, the patrons of such stores quickly become familiar with the traffic pattern such that the signs serve little purpose. Furthermore, since the signs are positioned close to the roadway, they are easily vandalized with spray paint and the like discharged from passing vehicles. The result is that directional signage often detracts from the appearance of the store and does not perform the intended function of directing drivers accessing the parking facilities. On the other hand, with the exception of the elevated signage designating the name of the franchiser, the directional signage is often the only dedicated signage approved by the municipality and the rectangular enclosure and supporting pedestal have been well constructed at considerable cost to the proprietor.

In all likelihood, the proprietors of many fast food stores have desired to use the space of directional signage to promote specials and the like offered by the franchiser rather than hanging signs within the windows of the store, but directional signs are not readily accessible because they are adapted to be opened only when the lighting fixture therein requires service. Also, the graphic material displayed by such signs is painted or printed on the forward panel of the enclosure which is retained and sealed into a frame so that water and contaminants do not enter the enclosure. The graphic display material in such signs, therefore, cannot be easily changed, rendering such signs unsuitable for displaying promotional material.

Also, because the graphic display material is printed or painted on the forward surface of the enclosure, the vandalizing of such signs with spray paint requires the proprietor to replace expensive graphic material.

It would be desirable to provide an improved directional sign for which the signage material would be more readily replaceable, such that alternate signage can be used to promote specials and the like. It would also be desirable to provide directional signage for which the graphic display material would not be destroyed when the forward surface of the sign is vandalized with spray paint.

SUMMARY OF THE INVENTION

Briefly, the present invention is embodied in a directional sign having an enclosure, a forward panel, and plurality of sides and perhaps a mounting pedestal. In accordance with the invention, the forward panel of the sign is made of a transparent material such as plastic or glass. The enclosure may also have a back panel which is not transparent, or the enclosure may have two opposing faces each of which has a transparent surface behind which is a removable panel of signage. A mounting is provided within the enclosure, behind the forward panel for removably retaining a planar panel of signage oriented to be visible through the transparent forward panel.

In the preferred embodiment, the enclosure has an opening in one side through which a panel of signage can be inserted into tracks mounted on the top and bottom surfaces of the enclosure. The panel of advertising material will be visible through the transparent forward panel and will be illuminated by the lighting fixture with the enclosure.

In another embodiment of the invention, the replaceable signage is printed on a panel of flexible material such as plastic, paper, or cloth and the flexible panel is retained to a stiff or partially rigid member, such as a sheet of plastic or a frame, to form a cartridge. The sides of the cartridge are adapted to fit in the tracks within the enclosure. To replace the signage material for a directional sign in accordance with this embodiment, the cartridge containing the existing signage is removed from the enclosure and the existing signage is disconnected from the rigid panel of the cartridge. Thereafter a flexible sheet of replacement signage is attached to the panel and the cartridge is reinserted into the tracks of the enclosure.

BRIEF DESCRIPTION OF THE DRAWINGS:

A better and more complete understanding of the present invention will be had after a reading of the following detailed description taken in conjunction with the drawings wherein.

DETAILED DESCRIPTION OF THE PREFERRED EMBODIMENT

Figure 1:
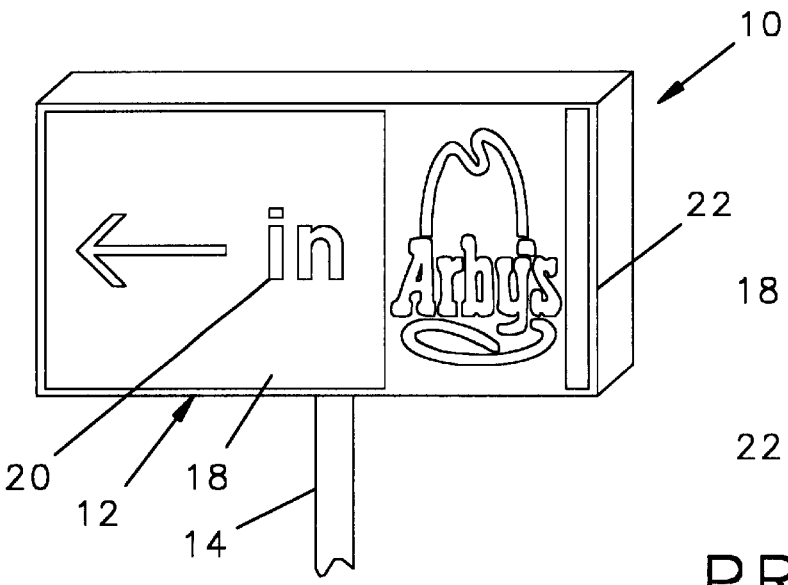
FIG. 1 is a front elevational view of a typical directional sign in accordance with the prior art.
Figure 2:
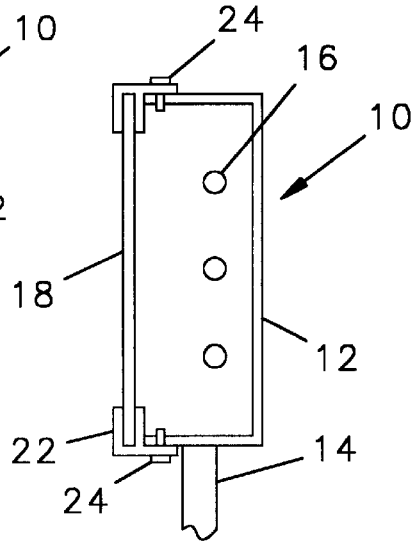
PRIOR ART FIG.2
FIG. 2 is a cross sectional view of the prior art directional sign shown in Fig. 1.

Referring to FIGS. 1 and 2, a prior art directional sign 10 has a rectangular enclosure 12 mounted on a pedestal 14. Within the enclosure 12 is a light fixture 16 for illuminating a partially transparent forward face 18 upon which the graphic material 20 has been painted. Typically, such graphic material 20 consists of no more than the word "enter" or the word "exit" or some variation thereof. The forward face 18 of such a prior art sign 10 is made of a stiff plastic and is retained in a rectangular frame 22, and the frame 22 is held to the body of the enclosure 12 by a plurality of screws 24 and a seal, not shown, prevents leakage between the forward surface and the frame. When the forward face 18 is vandalized by spray paint on the forward face 18, the frame 22 must be removed from enclosure 12 and the forward face 18 with the graphic display material 20 thereon must be removed from the frame 22 and replaced.

Figure 3:
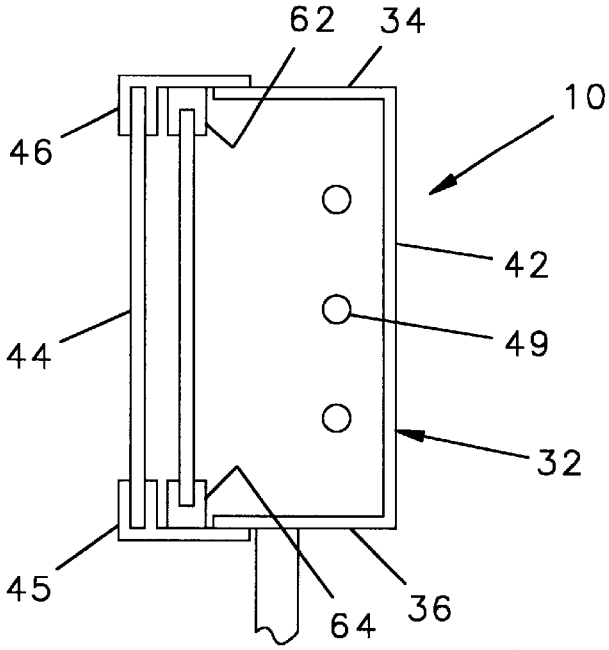
FIG. 3 is a cross sectional view of a sign mounting in accordance with the present invention.
Figure 4:
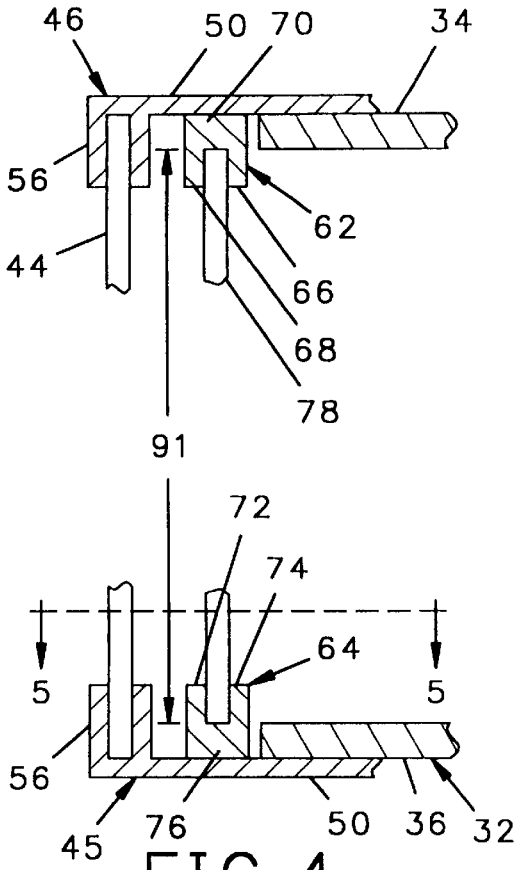
FIG. 4 is an enlarged fragmentary cross sectional view of the sign mounting shown in FIG. 3.
Figure 5:
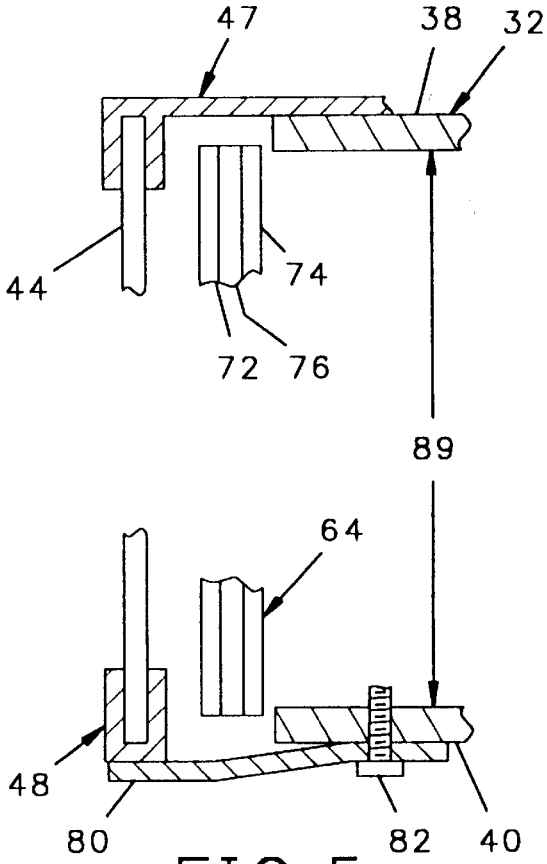
FIG. 5 is an enlarged fragmentary cross sectional view of the sign mounting shown in FIG. 3 taken through line 5—5 of FIG. 4.

Referring to FIGS. 3, 4, and 5, a sign mounting 30 in accordance with the present invention includes a rectangular enclosure 32 having upper and lower panels 34, 36, opposing sides 38, 40 and a rear panel 42, all of which are preferably made of metal. The enclosure further has a forward panel 44 of a transparent material such as plastic which is retained in place by a frame made of frame members 45, 46, 47, and 48. Mounted to the rear panel 42 is a lighting fixture 49 for illuminating such signage.

Figure 6:
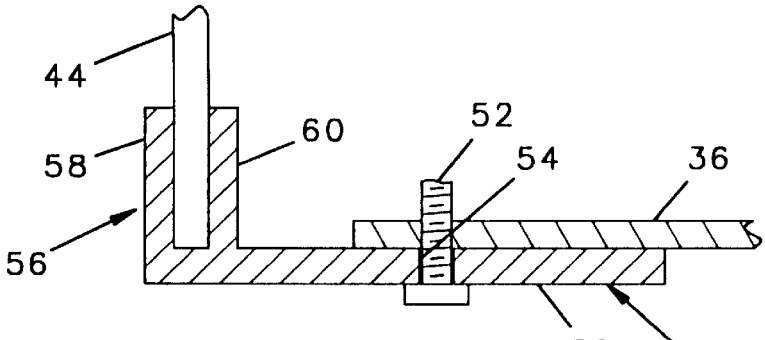
FIG. 6 is a further enlarged cross sectional view of a section of a frame member retaining the forward panel of the sign shown in FIG. 3.

Referring to FIG. 6, the frame members 45, 46, 47, 48 of which 45 is representative of all, are made of extruded metal and have an elongate mounting plate 50 attached by screws 52 through holes 54 to the forward edges of the upper and lower panels 34, 36 and sides 38, 40 such as panel 36 as shown. Attached along one side of the mounting plate 50 and extending perpendicularly thereto is a U-shaped retainer strip 56 having an outer plate 58 and an inner plate 60 between which the transparent forward panel 44 is retained.

As shown in FIGS. 4 and 5, the frame members 45, 46, 47, 48 are positioned with the retaining strip 56 forwardly offset from the forward edges of the upper and lower panels 34, 36 and sides 38, 40 to accommodate an upper track 62 and a lower track 64 along the inner surfaces of the mounting plates 50 of frame members 45 and 46 respectively. The upper track 62 has a cross sectional appearance of an inverted "U" with parallel downwardly extending legs 66, 68 joined at the upper ends thereof by a cross member 70, and the lower track 64 has U-shaped cross section with upwardly extending legs 72, 74 joined at the lower ends thereof by a cross member 76.

As shown in FIG. 5, the mounting plate 50 of frame member 48 has been removed, allowing an opening between the forward end of side 40 and the retainer strip 56 through which a transparent panel 78 (shown in FIG. 3), having signage material thereon, can be inserted. The opening is subsequently closed by a removable panel 80 attached by screws 82 threaded into the outer end of side 40. As shown in FIG. 4, the tracks 62, 64 are spaced from the retainer strip 56 of the frame a short distance to allow air to circulate between the forward panel 44 and the removable panel 78 to prevent moisture from condensing between the two panels.

Figure 7:
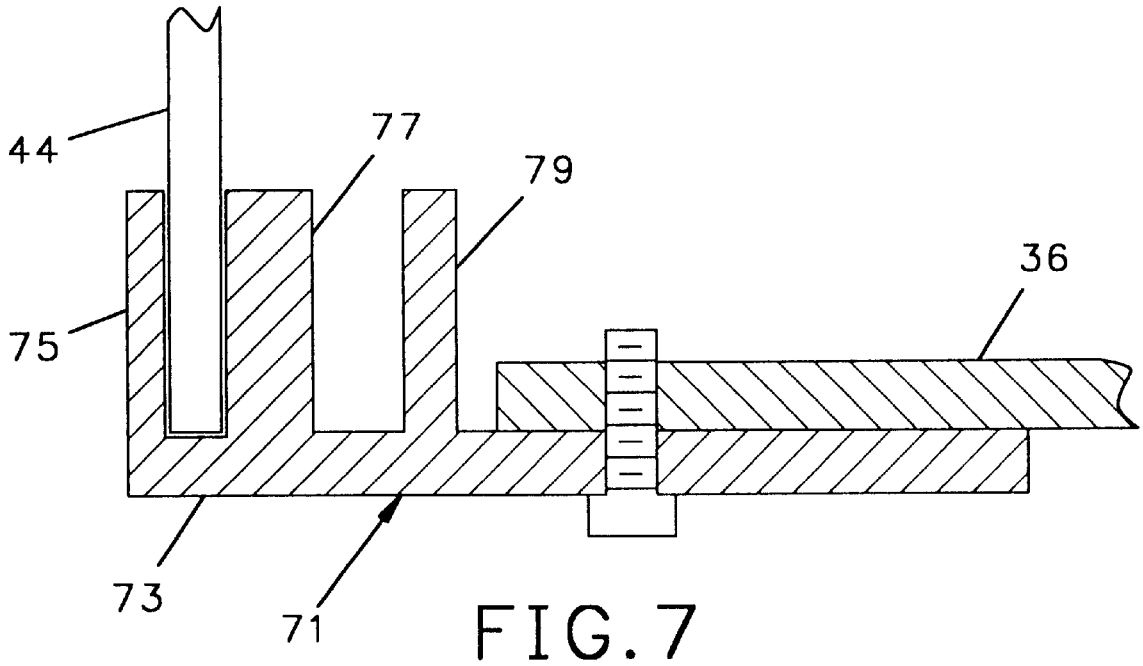
FIG. 7 is a cross sectional view of an alternate configuration of a frame member.

The tracks 62 and 64 are depicted as being glued or screwed to the inner surface of the mounting plate 50 along the upper and lower frame member 45, 46 respectively, however, the frame members 45, 46 and associated tracks 62, 64 could be extruded as a single piece. Referring to FIG. 7, a frame member 71 suitable for retaining the forward panel 44 having tracks for retaining a signage panel 78 has a planar mounting portion 73 and extruded along the inner surface of the planar mounting portion 73 are three ribs 75, 77, 79 separated from one another by spacings. The first rib 75 is positioned along the far left side of mounting portion 73 as seen in FIG. 7 and the space between the first rib 75 and the second rib 77 is equal to the thickness of the forward panel 44. The second rib 77 has a thickness which determines the spacing of the signage panel 78 from the rear surface of the forward panel 44. The spacing between the second rib 77 and the third rib 79 is equal to the thickness of the signage panel 78, or of the cartridge 84 as described below.

As can be seen in the embodiment shown in FIG. 1–7, if paint is sprayed on the forward panel 44, the panel can be replaced without replacing expensive signage thereon. Furthermore, the sign mounting 30 can be used as a directional sign or to display promotional material as needed by removing the screws 82 retaining the access panel 80 and replacing the signage panel 78 with another panel 78 having the desired signage material thereon. As previously stated, directional signs may have two "forward panels 44," one on each broad face of the sign, and in that event the sign would be constructed with a frame 45-48 and a removable panel 80 at each of the opposing faces 18 of the sign.

Figure 9:
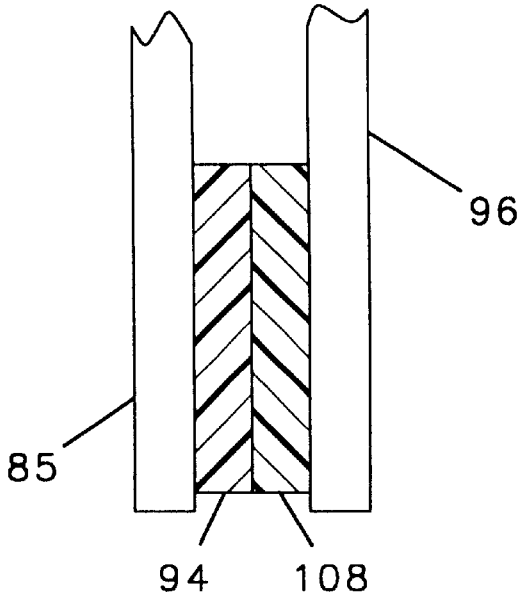
FIG. 9 is an enlarged, fragmentary cross sectional view of the cartridge shown in FIG. 8 taken through line 9—9 thereof.
Figure 8:
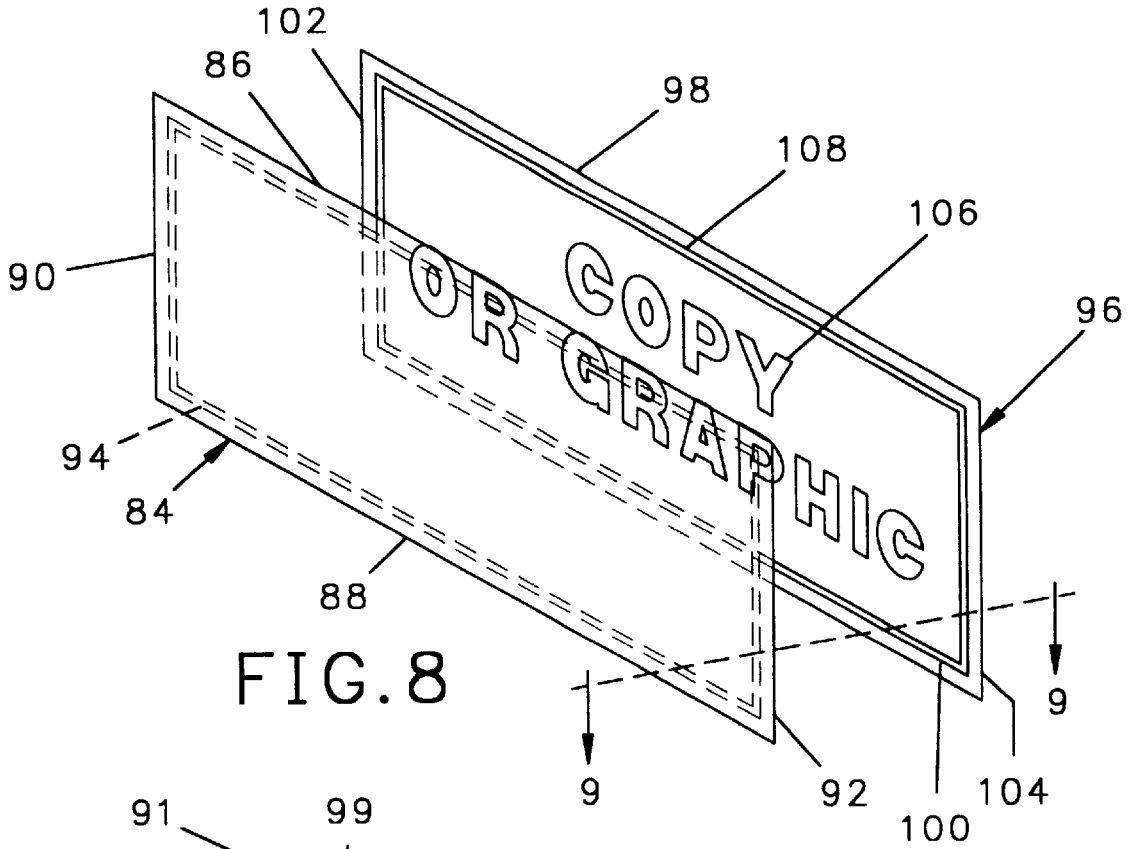
FIG. 8 is an exploded perspective view of a cartridge in accordance with the present invention for use in the sign mounting shown in FIG. 3.

Referring to FIGS. 8 and 9, the sign mounting 30 (as shown in FIG. 3) may also receive a sign cartridge 84 as described below. The cartridge 84 may have a greater thickness than the panel 78 and it should be obvious that the legs 66, 68, 72, 74 of the upper and lower tracks 62, 64 must be spaced far enough apart to receive the cartridge 84.

A cartridge 84 for use in the sign mounting 30 includes a planar transparent plastic generally rigid planar first panel 85 having parallel opposing long sides 86, 88 and parallel opposing short sides 90, 92. The long sides 86, 88 have a length which is a little shorter than the width 89 of the interior of the enclosure 32, as shown in FIG. 5, and the short sides 90, 92 have a length which is a little less than the height 91 between the upper surface of cross member 70 and the lower surface of cross member 76 as shown in FIG. 4. Extending parallel to the long sides 86, 88 and the short sides 90, 92, and spaced a short distance therefrom is a strip of connecting material 94 which may be the loop strips or hook strips of flexible connectors sold under the trademark Velcro.

Referring further to FIG. 8 and 9,attachable to the first panel 85 is a second signage panel 96 having long sides 98, 100 which are substantially equal in length of the long sides 86, 88 of the first panel 85 and short sides 102, 104 are substantially equal to the shorts sides 90, 92 of the first panel 85. The signage panel 96 further has display material 106 painted otherwise applied to one surface thereof, and extending around the forward surface thereof along the long and short sides 98, 100, 102, 104 is a strip of connecting material 108 complimentary to the connecting material 94 on the first panel 85. If, for example, the connecting material 94 is the loop strips of the connector sold under the trademark Velcro, then the connector material 108 of the display material panel 96 would be the hook strip of such Velcro connector.

The display material panel 96 is made of any appropriate material which can be retained to the first panel 85 and withstand the heat applied by the lighting fixtures 49 in the enclosure 32. Preferably, the panel 96 is also made of a flexible plastic material similar to that of the first panel 85, although it may be a thinner, more pliable, and therefore a less expensive grade of plastic.

In accordance with the invention, the panel 96 with the display material 106 thereon is retained to the first panel 85 by the connecting materials 94, 108 to form the cartridge 84. To insert the cartridge 84 into the sign mounting 30, the panel 80 is opened and the cartridge 84 is slide between the upper and lower tracks 62, 64 and behind the forward panel 44. When the cartridge 84 is fully installed, the panel 80 is reattached to seal the enclosure 32 against the elements.

As shown in FIG. 9, the connective material 94 on panel 85 and the connective material 108 on panel 96 space the panels 85, 96 a short distance away from each other. The spacing between the panels 85, 96 of the cartridge 84 allows air to circulate between the panels such that moisture will not form a cloud which would obstruct the view of the graphic material on the display panel 96.

In the event the proprietor desires to change the material in the sign mounting 30, the panel 80 is again opened, the cartridge 84 removed and the display material panel 96 is disconnected from the forward panel 85. Thereafter, a second piece of display panel 96 having graphics different than the first piece of signage material 96 is attached to the forward panel 85 and the new cartridge 84 is inserted into enclosure 32 following the procedure previously described.

As can be seen, new promotional material can be easily inserted into the sign mounting 30 by printing the new graphic material on a flexible signage panel 96 sized as described above and attaching it with the connecting material 94,108 to the first panel 85 to create a new cartridge 84 having graphics for the new promotion. The cost of the replacing the signage is merely the cost of the blank panel 96, plus the cost of printing the promotional graphics thereto, and the cost of the connecting material 108. In the event vandals apply spray paint or the like to the forward panel 44 of the sign mounting 30, the transparent material of the forward panel 44 may be removed from the frame 45–48 and replaced and the proprietor will not have to bear the cost of replacing expensive graphic material.

Figure 10:
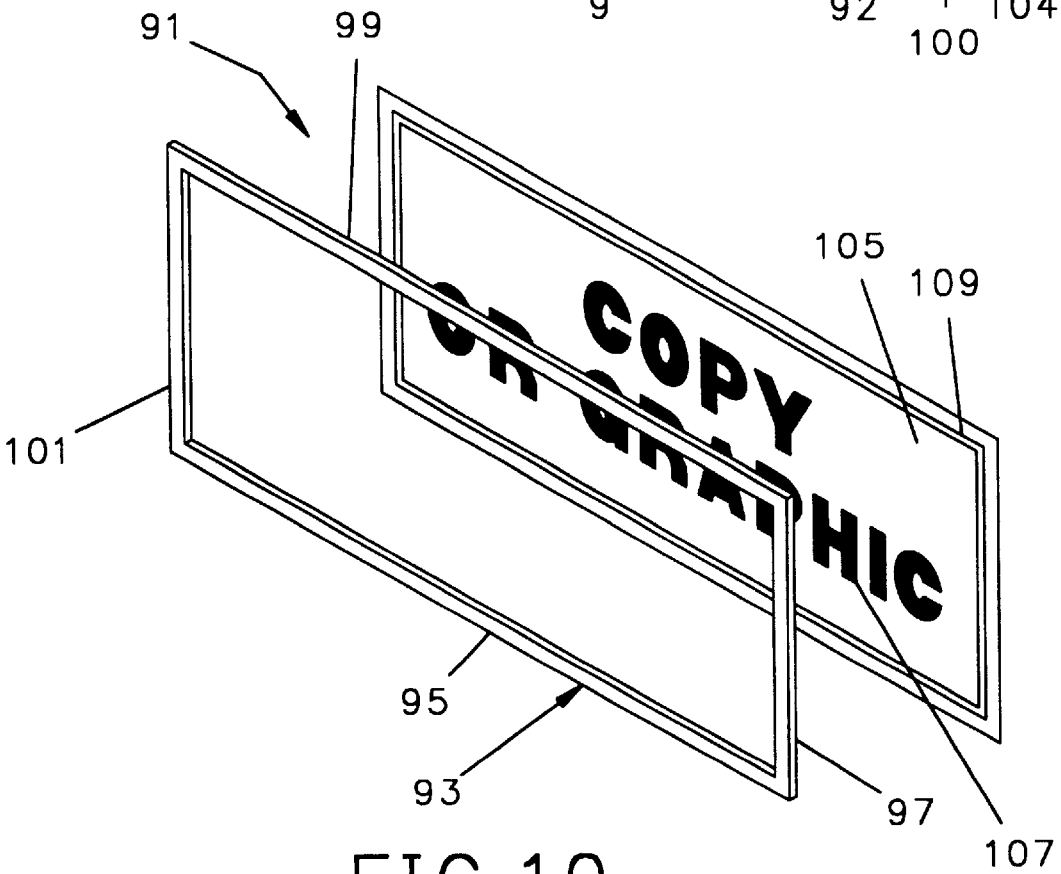
FIG. 10 is an exploded perspective view of a cartridge in accordance with a second embodiment of the invention.
Figure 11:
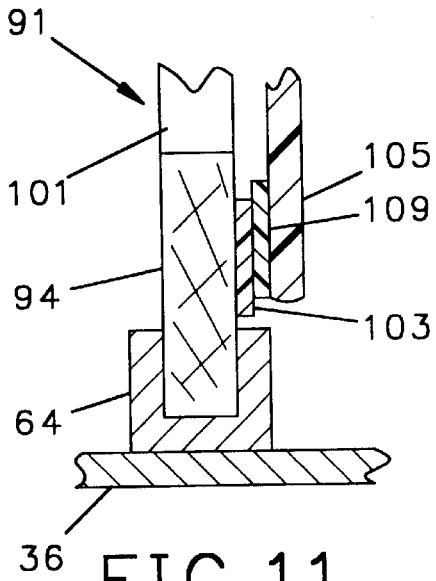
FIG. 11 is a fragmentary enlarged cross sectional view of the cartridge shown in FIG. 10 fitted into a track in the sign shown in FIG. 3.

Referring to FIGS. 10 and 11, in a second embodiment of a cartridge 91 for use in the sign 30, a rectangular frame 93 made of metal, wood or plastic has side members 95, 97, 99, 101 with outer dimensions sized to fit through the opening behind panel 80 and into the tracks 62, 64 for retaining the cartridge. Attached to the rear surface of the side members 95, 97, 99, 101 is one portion 103 of an attachment device such as the hook and loop attachment device sold under the trademark Velcro. A transparent panel 105 of material such as Plexiglas or the like has display material 107 printed thereon and around the edges of the panel 105 is a strip of attachment material 109 complementary to the portion 103 on the frame 93. The panel 105 is sized to fit within the enclosure of the sign 30 with the attachment material 109 positioned on the forward surface thereof and positioned to contact portion 103 to retain the panel 105 to the frame 93.

Figure 12:
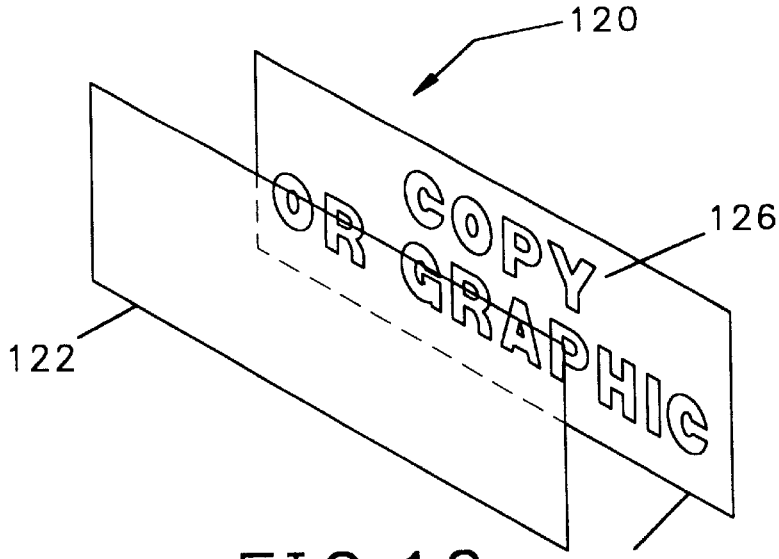
FIG. 12 is an exploded perspective view of a cartridge in accordance with a third embodiment of the invention.
Figure 13:
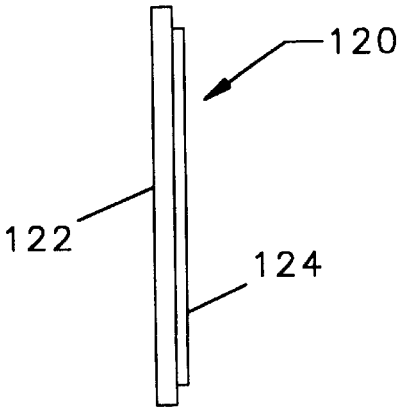
FIG. 13 is a side elevational view of the cartridge shown in FIG. 12.

Referring to FIGS. 12 and 13, a third embodiment of a cartridge 120 for use in the sign 30 consists of a rigid rectangular panel 122 of a suitable transparent material having electromagnetic properties, such as Plexiglas, having outer dimensions sized to fit within the upper and lower tracks 62, 64. Retained to the panel 122 by electromagnetic attraction is a second, flexible panel 124 of transparent material having suitable electromagnetic properties, such that assembled panels 122, 124 form the cartridge 120. Printed on the surface of the second panel 124, or imbedded into the material of the second panel 124, is display material 126.

Figure 14:
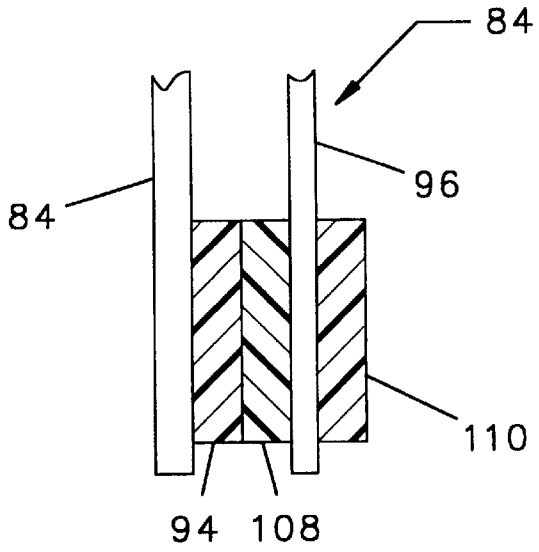
FIG. 14 is a fragmentary end view of a second embodiment of a graphics display panel for use in the cartridge shown in FIGS. 8 and 9.
Figure 15:
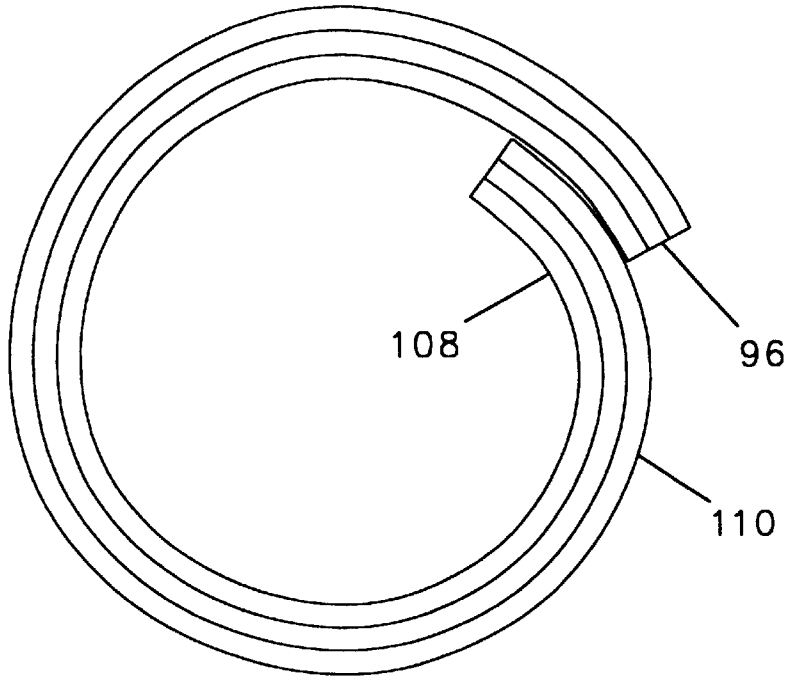
FIG. 15 is a fragmentary end view of the graphics display panel shown in FIG. 14 rolled up for storage.

Referring to FIGS. 14 and 15, in another embodiment of the invention, the flexible graphic display panel 96 may further have strips of connecting materials 110 along the long side 98, 100 of the rearward surface 112 as shown. The connecting strips 110 of the rear surface are connecting material which are complimentary to the connecting material 108 on the forward surface thereof such the second panel 96 may be rolled into a coil and retained in the rolled position by connecting materials 108, 110 as shown in FIG. 15.

While the present invention has been shown in several embodiments, it will be appreciated that many modifications and variations may be made without departing from the true spirit and scope of the invention. It is therefore the intent of the following claims to cover all such modifications and variations which come within the true spirit and scope of the invention.

What is claimed is:

1. A sign comprising an enclosure having a plurality of walls and an open forward end, a transparent panel having a plurality of edges, said transparent panel desposed across said open forward end, a retaining frame along said plurality of edges for retaining said transparent panel across said open forward end, said retaining frame including a plurality of frame members overlapping and parallel to said wall of said enclosures, a first track and a second track within said enclosure and behind said transparent panel, said first and second tracks oriented parallel to said transparent panel, said first track mounted against a first retaining frame member and said second track mounted against a second retaining frame member opposite said first retaining frame member, each of said first and second tracks having a U-shaped cross section, a rigid frame having four frame members, said frame slideable between said first and second tracks, a planar panel having graphic material thereon, means for attaching said planar panel having graphic material thereon to at least two of said frame members wherein said graphic material is visible through said transparent forward surface.

2. A sign in accordance with claim 1 wherein one of said retaining frame members has an opening through which said frame may be inserted into and removed from between said first and second tracks.

3. A sign according to claim 2 and further comprising means for closing said opening in said one of said retaining frame members.

4. A sign in accordance with claim 1 and further comprising a light fixture in said enclosure.

5. A sign according with claim 1 wherein said means for retaining said planar panel comprises loops and hooks connectors sold under the trademark Velcro.

6. A signage cartridge for use with a sign mounting having an enclosure with a first track and a second opposing track within said enclosure, each of said first and second tracks having a parallel track members for removeably retaining said signage cartridge between said opposing tracks, said cartridge comprising a panel of stiff transparent material, said panel of stiff transparent material having first and second opposing edges engagable between said track members of-said first and second opposing tracks, a flexible panel with graphic material thereon, and connecting means on said panel of stiff transparent material for removeably attaching said flexible panel to said panel of stiff material, said flexible panel having a forward surface and a rearward surfaces said connector being of the hook and loop type sold under the trademark Velcro and positioned along the edges of both said forward surfaces and said rearward surfaces of said flexible panel, and said connectors on said forward surface being complementary to those on said rearward surface whereby said flexible panel may be rolled into a cylindrical configuration and retained in said cylindrical configuration by said connectors.

* * * * *